United States Patent [19]

Carr

[11] 3,999,964

[45] Dec. 28, 1976

[54] ELECTROSTATIC AIR CLEANING APPARATUS

[75] Inventor: Allan W. Carr, Seymour, Tenn.

[73] Assignee: Carrier Corporation, Syracuse, N.Y.

[22] Filed: Mar. 28, 1975

[21] Appl. No.: 563,017

[52] U.S. Cl. ..... 55/138; 55/131; 55/147; 55/148; 55/154; 55/499; 55/521

[51] Int. Cl.[2] ..... B03C 3/04

[58] Field of Search ..... 55/124, 130, 131, 132, 55/138, 139, 147, 148, 154, 497, 499, 521

[56] References Cited

UNITED STATES PATENTS

| | | | |
|---|---|---|---|
| 2,502,560 | 4/1950 | Dahlman | 55/132 |
| 2,579,441 | 12/1951 | Palmer | 55/131 |
| 2,739,667 | 3/1956 | Palmore | 55/499 |
| 2,847,082 | 8/1958 | Roos | 55/132 |
| 2,933,151 | 4/1960 | Kuntz | 55/124 |
| 3,222,848 | 12/1965 | Koble, Jr. | 55/131 |
| 3,800,509 | 4/1974 | Carr et al. | 55/138 |

*Primary Examiner*—Bernard Nozick
*Attorney, Agent, or Firm*—J. Raymond Curtin; Barry E. Deutsch

[57] ABSTRACT

An electrostatic air cleaning apparatus having a source of relatively large magnitude electrical voltage. The cell comprises a charged ionizing section and a collecting section comprising a charged grid and a grounded grid sandwiching therebetween a sheet of foraminous filter media. One of the grids is movable relative to the other grid. A single bus bar electrically connects the ionizing section and the charged grid to the source of voltage. The movable grip is positioned with respect to the stationary grid via support surfaces. Retainers maintain the movable grid in its desired position.

4 Claims, 5 Drawing Figures

ELECTROSTATIC AIR CLEANING APPARATUS

BACKGROUND OF THE INVENTION

This invention relates to an electrostatic air cleaning apparatus, and in particular, to a type having a collecting section, including a first charged grid, and a second grounded grid sandwiching therebetween a sheet of foraminous filter media.

As is known to those skilled in the art, electrostatic precipitation or air cleaning apparatus are generally installed as part of duct systems employed with forced air heating and/or cooling apparatus serving enclosures such as residences or the like. The apparatus generally includes a power pack which transforms conventional household AC voltage to a DC power source of substantial voltage. The increased DC voltage is applied to ionizer and collector sections of the apparatus for the purpose of creating electrostatic fields in the area traversed by the air stream flowing through the duct system.

Generally, the ionizer section comprises a plurality of wires, each of which is disposed adjacent a plate so as to define a plurality of passages, each with an electrostatic field disposed therein. The electrostatic fields thus formed are of a magnitude that a corona discharge is generated from the wire. Particles of dirt or dust entrained in air flowing within the plurality of passages receive an electrical charge of a particular plurality to enable such dirt to be readily removed from the air stream at the collector section of the apparatus.

The collector section of the apparatus generally comprises a plurality of alternately charged and grounded members having electrostatic field created therebetween whereat the charged particles are removed from the air stream and collected. A first form of collector section comprises a plurality of alternately charged and grounded plates. Another form of collector section comprises alternately charged and grounded grids sandwiching a suitable foraminous filter media. The present invention is particularly suitable for use with collector sections of the second type.

Although electrostatic air cleaning apparatus are considerably more efficient than mechanical filters in removing dirt and other foreign particles entrapped in an air stream, the initial cost of such apparatus has somewhat discouraged the potential consumers from obtaining such apparatus. Accordingly, manufacturers of such apparatus have attempted to reduce the cost thereof. However, in some cases, attempted cost reductions have resulted in poor performing apparatus.

In addition, one of the grids forming the collector section must be made movable to permit the filter media to be removed for cleaning or replacement purposes. If the movable grid is not accurately repositioned with respect to the stationary grid, non-uniform electrostatic fields will be generated resulting in inefficient operation of the apparatus.

SUMMARY OF THE INVENTION

Accordingly, it is an object of the invention to manufacture a compact high performing electrostatic air cleaning apparatus.

It is a further object of this invention to reduce the cost of manufacturing electrostatic air cleaning apparatus without impairing its operating performance.

It is a further object of this invention to manufacture a collector section having alternately charged and grounded grids sandwiching therebetween a sheet of foraminous filter media wherein such collector section is of compact design.

It is a further object of this invention to maintain the plates of the grounded grids uniformly spaced from the plates of the charged grid.

These and other objects of the present invention are obtained in an electrostatic air cleaning apparatus having a source of relatively large magnitude electrical voltage. The apparatus includes a cell comprising a charged ionizing section and a collecting section comprising a charged grid and a grounded grid sandwiching therebetween a sheet of foraminous filter media. One of the grids is movable relative to the other grid. A single bus bar electrically connects the ionizing section and the charged grid to the source of voltage. The movable grid is accurately positioned with respect to the stationary grid via support surfaces. Retainers maintain the movable grid in its desired position.

DESCRIPTION OF THE PREFERRED EMBODIMENT

Figure 1:
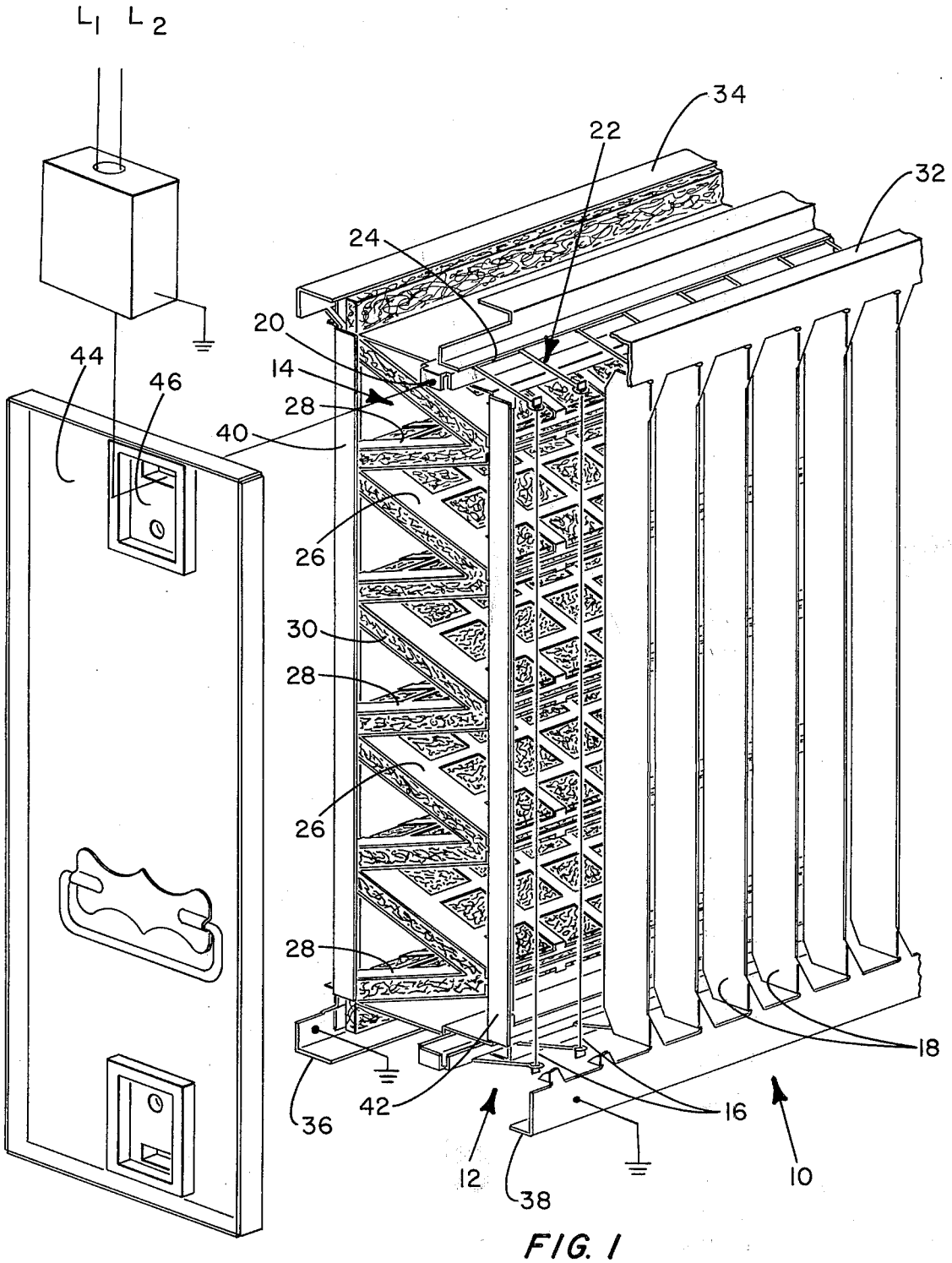
FIG. 1 is a perspective view of a cell employed in electrostatic air cleaning apparatus of the present invention.

Referring now to the drawings, there is shown a preferred embodiment of the present invention. In referring to the various figures of the drawings, like numerals shall refer to like parts.

There are many applications in which electrostatic air cleaning apparatus may be employed. A forced air heating system, of a type providing warm air to a residential building, is typical of installations employing such air cleaning apparatus. A forced air heating system includes a forced air furnace. As known to those skilled in the art, a forced air furnace includes a combustion section where a suitable fuel, for example, natural gas, is ignited to provide heat to raise the temperature of air being supplied to various rooms of a building. The relatively warm temperature air is delivered through a suitable supply duct system by the operation of a fan. The air is returned from the various rooms of the building also through a suitable duct system. The electrostatic air cleaning apparatus is generally installed in the return duct system upstream from the inlet to the furnace. The apparatus is suitably positioned so the return air being provided to the furnace must pass through the air cleaning apparatus whereat foreign particles entrapped within the air stream are removed therefrom.

With particular reference to FIG. 1 of the drawings, there is shown a preferred form of electrostatic cell of the type employed in electrostatic air cleaning apparatus. In particular, cell 10 includes an ionizing section 12 and a collecting section 14. In the ionizing section, air having foreign particles entrained therein is directed through electrostatic fields whereat the foreign particles obtain an electrostatic charge. Thereafter, the air stream including the charged foreign particles is directed to the collecting section whereat the charged foreign particles are withdrawn from the air stream.

Ionizing section 12 of cell 10 includes a plurality of elongated ionizing wires 16. The ionizing wires are mounted adjacent the entrance to the air cleaning apparatus. Grounded plates 18 disposed slightly upstream from the ionizing wires, are provided to establish electrostatic fields in combination with the ionizing wires. Ionizing wires 16 are suitably connected to bus bar 20. Bus bar 20 is connected to a source of relatively large magnitude DC voltage represented by line L1 and L2 via conductor 46 disposed in end panel 44. Typically, a power pack 61 is provided which converts normal household AC voltage to a DC voltage of substantial magnitude, for example in the range of 6,000 to 7,000 volts. The negative terminal of the power pack is grounded. Preferably, adjacent pairs of ionizing wires 16 are suitably connected to resilient spring members 22. Spring members 22 are electrically conductive and are disposed in a plurality of slots 24 formed along the axial length of the bus bar. As is more fully described in co-pending application, Ser. No. 563,016, filed Mar. 28, 1975, and assigned to the same assignee as the assignee hereof, the spring members are employed in the mounting system for connecting the ionizing wires to the bus bar.

The air cleaning apparatus further includes a charged grid 26 spaced from a grounded grid 28. Grids 26 and 28 sandwich therebetween a sheet of foraminous filter media 30. The grids respectively comprise a plurality of V-shaped plates 29 having square-shaped openings or perforations 31. Perforations 31 are provided to permit air to flow from the inlet to the outlet of the apparatus. The alternately charged and grounded grids develop electrostatic fields whereby the foreign particles entrained in the air stream are collected at the foraminous filter media.

Figure 2:
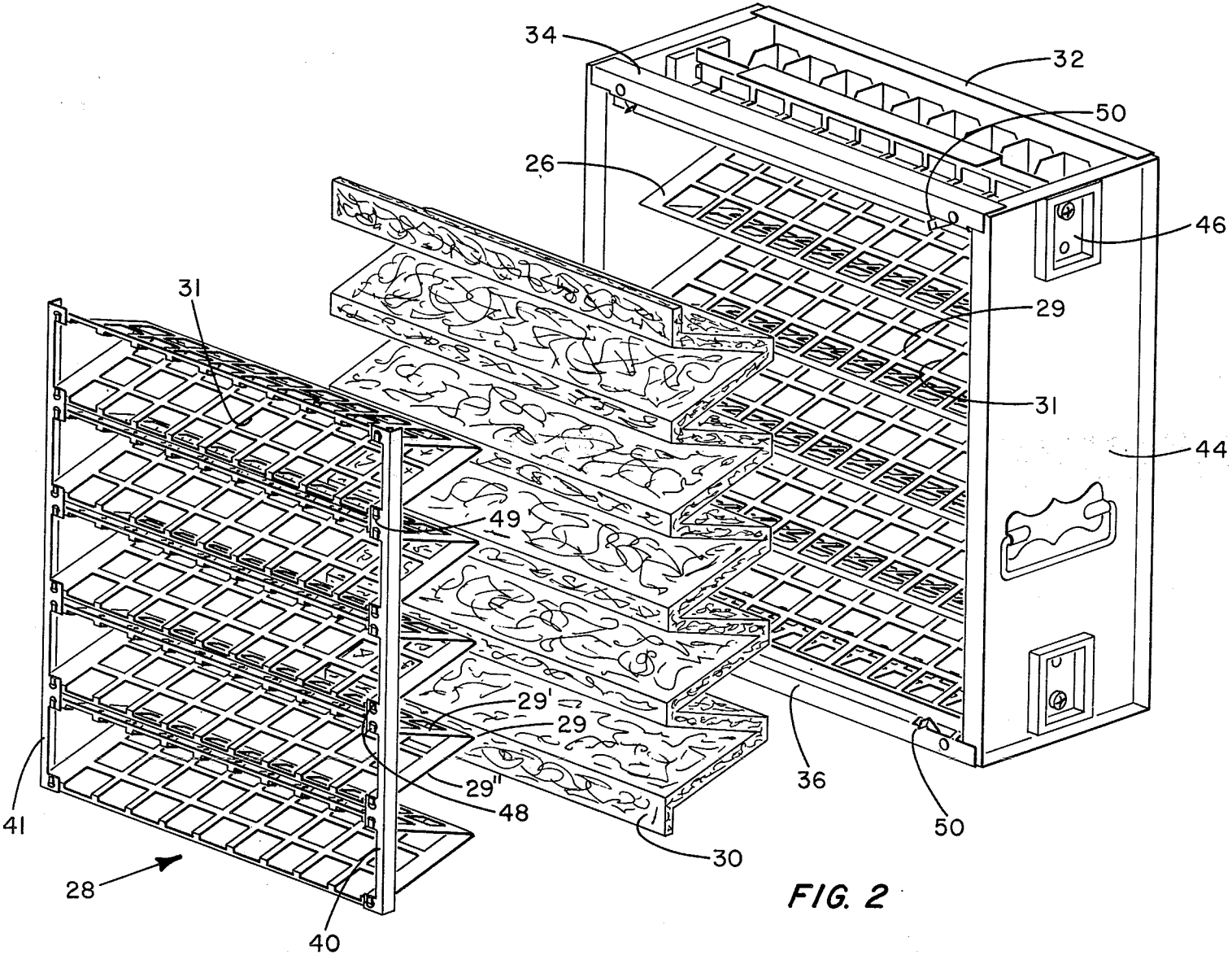
FIG. 2 is an exploded perspective view of the electrostatic cell.
Figure 3:
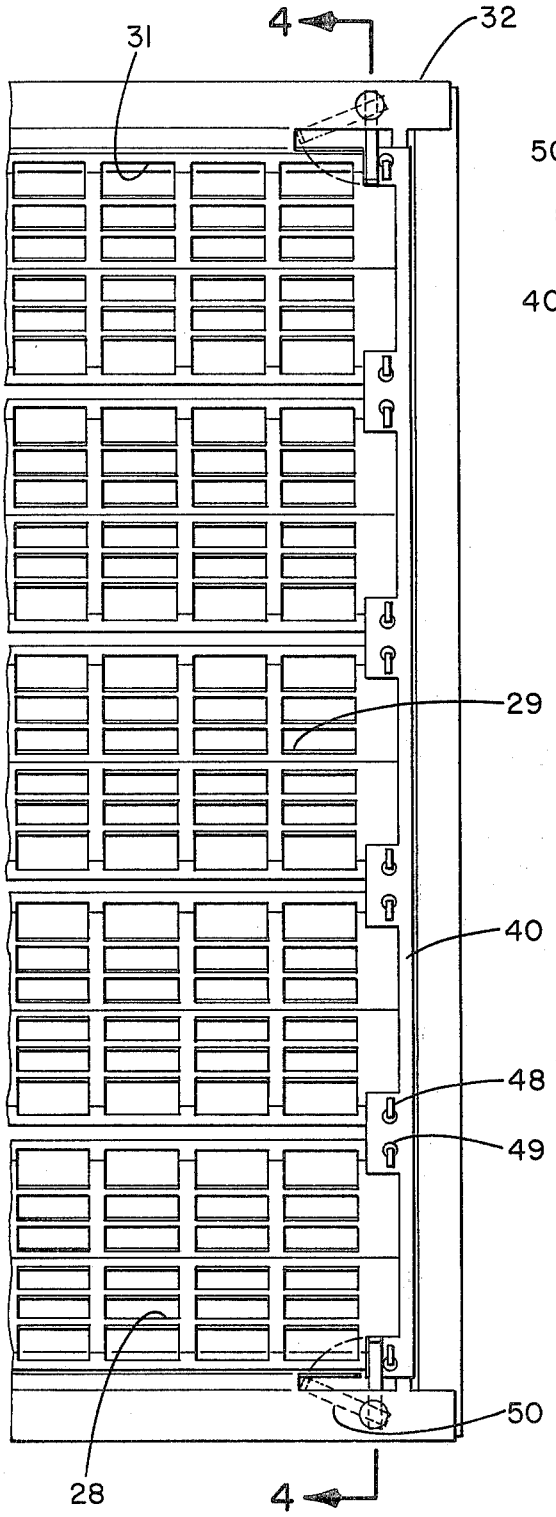
FIG. 3 is a plan view taken from the rear of the cell.
Figure 5:
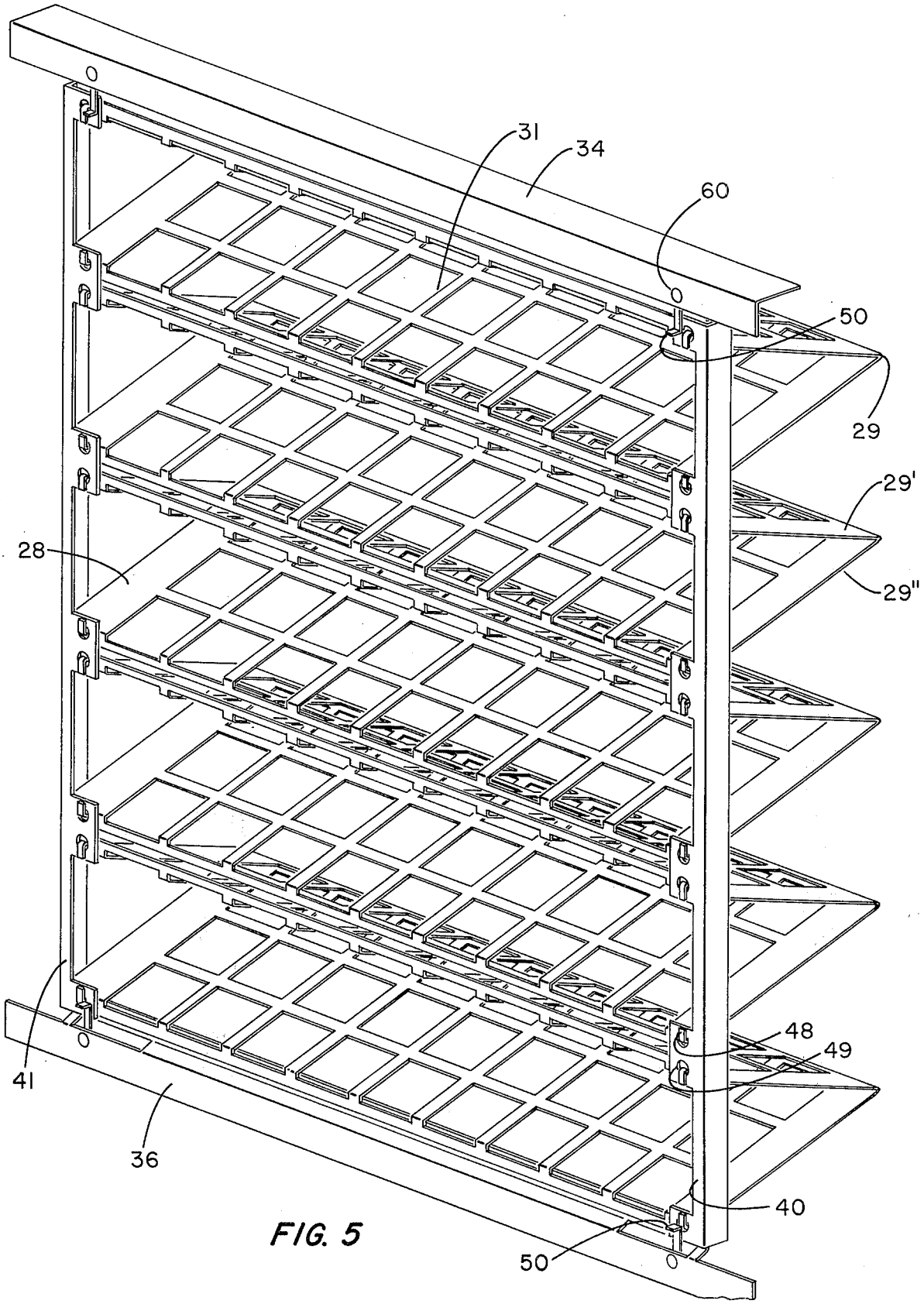
FIG. 5 is a perspective view of a detail of a portion of the cell of the present invention.

The support frame for electrostatic cell 10 includes top support members 32 and 34, and bottom support members 36 and 38. As is illustrated in FIGS. 2, 3 and 5, grounded grid 28 is attached at either end to L-shaped channel members 40 and 41. Preferably, each end of each of the legs 29' and 29'' of V-shaped perforated plates 29 comprising grounded grid 28 terminate in a tab 48. Side support members 40 and 41 include a plurality of openings 49 for receiving the tabs which are bent over once inserted through the openings to permanently connect the plates to the support members. Preferably, the charged grid is manufactured in the same manner whereby the perforated plates thereof include tab means which extend through openings formed in side support members 42, only one of which is shown. By employing the tabs and corresponding openings in the support members, the plates of the grid may be quickly and economically connected to their support structure. The need for screws, rivets or similar means to attach the plates is eliminated.

At regular intervals, it is necessary that the foraminous filter media be removed for either cleaning or replacement purposes. Accordingly, one of the grids sandwiching filter media 30 must be movable to permit the removal of the filter media. In the present embodiment, grounded grid 28 may be removed from the cell to permit foraminous filter media 30 to be withdrawn. Retainer means 50, shown as rotatable clips pivotally connected to top and bottom support members 34 and 36 via rivets 60 retain grid 28 in place and permit the removal thereof when desired. As illustrated in FIG. 3, clips 50 are moved to the dotted line position when it is desired to remove grid 28.

In order to maintain the design as compact as possible, both ionizing wires 16 and charged grid 26 are connected to the identical bus bar 20. This particular feature is disclosed specifically in FIG. 4. The top plate forming grid 26 terminates in upstanding flange 25 which is attached via suitable means, such as screws 27, to bus bar 20. As noted previously, ionizing wires 16 are electrically connected to the bus bar via springs 22. The single electrically conductive bus bar thus connects both the charged grid and the charged ionizing wires to the source of the relatively high magnitude DC voltage.

In order to insure efficient operation of the air cleaning apparatus, it is important that the spacing between the charged and grounded grids respectively 26 and 28 be maintained uniform so that the electrostatic fields generated therebetween are of equal magnitude. Openings 49 in members 40 and 41, in combination with tabs 48 extending from the ends of plates 29, insure that the plates are equally spaced along the support members. As noted before, the charged grid will preferably have a similar construction.

Figure 4:
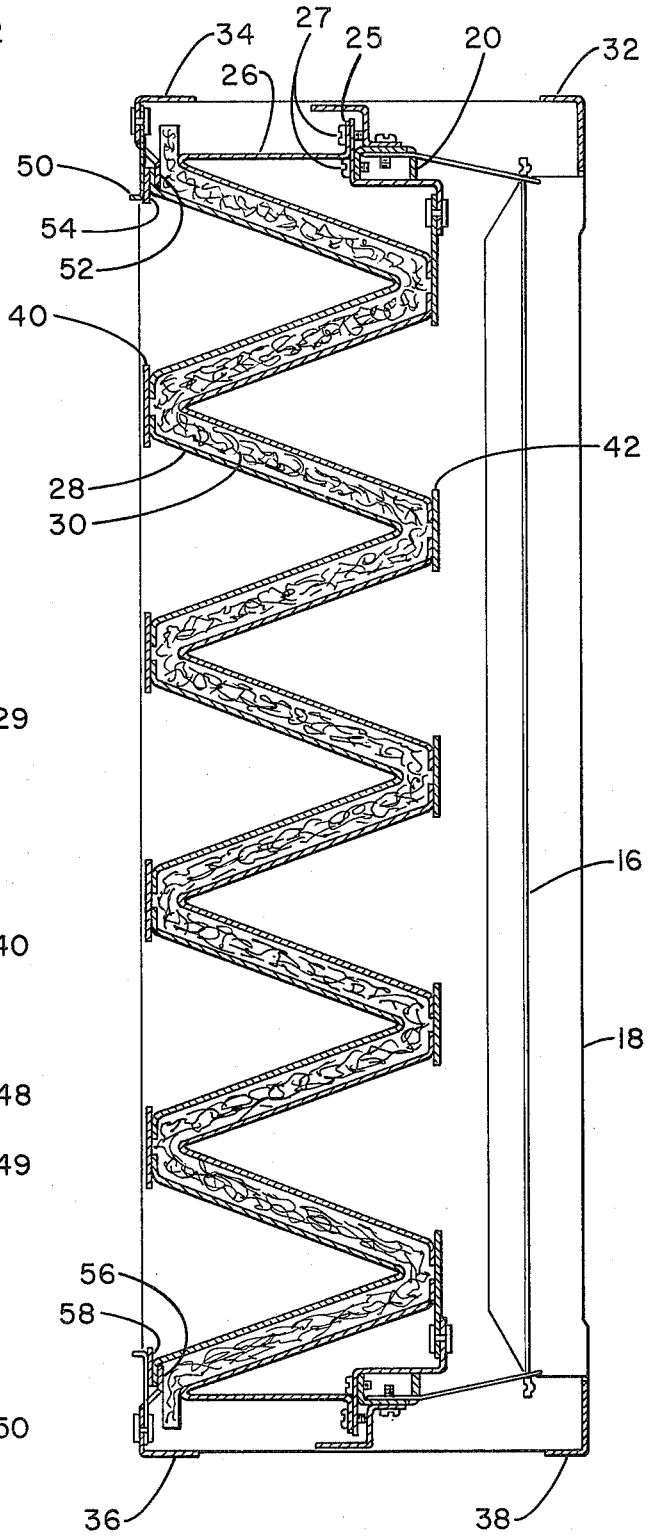
FIG. 4 is a sectional view taken along the lines IV—IV of FIG. 3.

As illustrated in FIG. 4, the top and bottom plates forming the grounded grid have respectively upwardly and downwardly extending flanges respectively 54 and 58. Flange 54 is disposed within a space defined between retainer means 50 and an offset vertically extending flange 52. Flange 52 is integrally formed with top support member 34 and is offset inwardly relative thereto to define an outwardly facing bearing surface against which flange 54 of grid member 28 rests. Lower support member 36 similarly has an offset vertically extending flange 56. Flange 56 provides an outwardly facing bearing surface against which flange 58 rests. The bearing surfaces defined by flanges 52 and 56 and provided at the top and bottom of the support structure provide positive locating means to accurately position grid 28 relative to stationary grid 26 when the movable grid is reinserted in the cell.

The electrostatic air cleaning apparatus disclosed herein is of compact and economical design and is of efficient operating performance.

While a preferred embodiment of the present invention has been described and illustrated, the invention should not be limited thereto, but may be otherwise embodied within the scope of the following claims.

I claim:

1. Electrostatic air cleaning apparatus comprising:

a source of relatively large magnitude electrical voltage;

a support frame defining an air inlet and an air outlet for an air stream passing through said air cleaning apparatus; and an electrostatic cell mounted on said support frame and comprising an ionizing section including a plurality of ionizing wires disposed substantially adjacent said apparatus inlet; a collecting section disposed downstream of said ionizing wires and including first and second grids sandwiching therebetween a sheet of foraminous filter media wherein said grids include a plurality of perforated V-shaped plates having tabs extending outwardly from each end of the legs thereof, and first and second parallel, spaced apart support members having a plurality of spaced apart holes equal in number to the number of said tabs and formed along the axial length thereof for receiving the tabs to connect the plates to the support members; and a single bus bar in electrical contact with said source of voltage, and being further electrically connected to said ionizing wires, and to a selected one of said grids, with said other of said grids being grounded, whereby a first electrostatic field is generated at said ionizing section to provide a charge on foreign particles entrapped in an air stream moving through said apparatus, and a second electrostatic field is generated at said collecting section of said electrostatic cell to remove said charged foreign particles from said air stream.

2. Electrostatic air cleaning apparatus comprising:

a source of relatively large magnitude voltage;

an electrostatic cell comprising an ionizing section electrically connected to said source of voltage to provide a charge on foreign particles entrapped in an air stream moving through said apparatus; and a collecting section whereat said foreign particles are removed from said air stream and including first and second grids sandwiching therebetween a sheet of foraminous filter media, a selected one of said grids being electrically connected to said source of voltage, one of said grids being movable relative to said other grid and including a pair of spaced apart supports having a plurality of V-shaped perforated plates connected thereto; and a support frame defining an air inlet and an air outlet for air passing through said air cleaning apparatus including means defining an opening to permit the movement of said one grid relative to said other grid, and including first and second spaced apart members mounting retainer means for retaining said movable grid in position relative to said other grid, each of said spaced apart members including opposed vertically extending flanges offset inwardly relative to said retainer means to define a space therebetween for receiving corresponding flanges extending from the respective upper and lower ends of the plates connected at the top and bottom of the supports, the flanges on said spaced apart members defining outwardly facing bearing surfaces for positioning said movable grid within said opening.

3. Electrostatic air cleaning apparatus in accordance with claim 2, wherein said V-shaped plates have tabs extending outwardly from each end of the legs thereof, and said spaced apart supports include a plurality of spaced apart holes equal in number to the number of tabs and formed along the axial length thereof for receiving the tabs to connect the plates to the supports.

4. Electrostatic air cleaning apparatus comprising:

a source of relatively large magnitude electrical voltage;

a support frame defining an air inlet and an air outlet for an air stream passing through said air cleaning apparatus;

an electrostatic cell comprising an ionizing section including a plurality of ionizing wires disposed substantially adjacent said inlet of said apparatus; and a collecting section disposed downstream of said ionizing wires and including first and second grids sandwiching therebetween a sheet of foraminous filter media, one of said grids being electrically connected to said source of voltage, a selected one of said grids being movable relative to said other grid and including a pair of spaced apart supports having a plurality of V-shaped perforated plates connected thereto; and a single bus bar in electrical contact with said source of voltage, with said ionizing wires, and with a selected one of said grids, with said other of said grids being grounded, whereby a first electrostatic field is generated at said ionizing section to provide a charge on foreign particles entrapped in said air stream entering said inlet of said apparatus, and a second electrostatic field is generated at said collecting section to remove said charged foreign particles from said air stream; and said support frame including means defining an opening and including first and second spaced apart members mounting retainer means for retaining said movable grid in position relative to said other grid, each of said spaced apart members including opposed vertically extending flanges offset inwardly relative to said retainer means to define a space therebetween for receiving corresponding flanges extending from the respective ends of the plates connected at the top and bottom of the supports, the flanges on said members defining outwardly facing bearing surfaces for positioning said movable grid within said opening.

* * * * *